US007976590B2

(12) United States Patent
Boux et al.

(10) Patent No.: US 7,976,590 B2
(45) Date of Patent: Jul. 12, 2011

(54) FUEL OR FUEL ADDITIVE COMPOSITION AND METHOD FOR ITS MANUFACTURE AND USE

(75) Inventors: Hubert Boux, North Saanich (CA); Anne Moya Flanagan, Sidney (CA)

(73) Assignee: Global Terralene Inc., Victoria, British Columbia (CA)

( * ) Notice: Subject to any disclaimer, the term of this patent is extended or adjusted under 35 U.S.C. 154(b) by 523 days.

(21) Appl. No.: 11/937,381

(22) Filed: Nov. 8, 2007

(65) Prior Publication Data

US 2008/0104884 A1 May 8, 2008

Related U.S. Application Data

(60) Provisional application No. 60/864,928, filed on Nov. 8, 2006, provisional application No. 60/944,576, filed on Jun. 18, 2007.

(51) Int. Cl.
*C10L 1/18* (2006.01)

(52) U.S. Cl. ..... 44/385; 44/388; 44/411; 44/437; 44/438; 44/439; 44/451

(58) Field of Classification Search ..... 44/351, 44/385, 388, 411, 451, 437, 438, 439
See application file for complete search history.

(56) References Cited

U.S. PATENT DOCUMENTS

| | | | | |
|---|---|---|---|---|
| 4,300,912 | A | | 11/1981 | Townsend |
| 4,818,250 | A | | 4/1989 | Whitworth |
| 4,915,707 | A | | 4/1990 | Whitworth |
| 5,186,722 | A | | 2/1993 | Cantrell et al. |
| 5,417,725 | A | * | 5/1995 | Graves ..... 44/388 |
| 5,501,713 | A | | 3/1996 | Wilkins, Jr. |
| 5,575,822 | A | | 11/1996 | Wilkins, Jr. |
| 5,730,029 | A | | 3/1998 | Stoldt et al. |
| 5,743,923 | A | | 4/1998 | Davies et al. |
| 2005/0223628 | A1 | | 10/2005 | Mawdsley |

FOREIGN PATENT DOCUMENTS

| | | | |
|---|---|---|---|
| CA | 1340871 | | 1/2000 |
| CA | 2513001 | | 7/2004 |
| CA | 2 556 650 | | 2/2008 |
| CN | 1667095 | * | 9/2005 |
| JP | 58074788 | | 5/1983 |
| JP | 20044292721 | | 10/2001 |
| JP | 2006321960 | | 11/2006 |

OTHER PUBLICATIONS

Barton and Knight 1997, Chemistry in Australia 64 (1): 4-6.
Barton and Tjandra 1988, Fluid phase eqilibria 44:117-123, 1989, Fuel 68:11-17.
U.S. Appl. No. 10/506,963, filed Apr. 20, 2005, Mawdsley.
International Search Report and Written Opinion in International Application No. PCT/CA2009/000628, dated Aug. 18, 2009.

* cited by examiner

*Primary Examiner* — Cephia D Toomer
(74) *Attorney, Agent, or Firm* — Klarquist Sparkman, LLP

(57) ABSTRACT

Embodiments of a composition useful as a fuel or fuel additive are provided. Certain disclosed embodiments of the composition comprise mid to low flash point naptha, at least one alcohol having a ratio of between about 1 to about 4 carbon atoms to 1 hydroxyl functional group, at least one lubricating oil, and at least one oxygenated natural aromatic compound, wherein the oxygenated natural aromatic compound has a flash point between about 60° C. and about 160° C., has at least one oxygenated functional group, and is soluble in the composition.

25 Claims, No Drawings

FUEL OR FUEL ADDITIVE COMPOSITION AND METHOD FOR ITS MANUFACTURE AND USE

CROSS REFERENCE TO RELATED APPLICATIONS

This application claims benefit of U.S. Provisional Patent Application No. 60/864,928, filed on 8 Nov. 2006, and entitled "FORMULATION FOR USE AS A FUEL OR FUEL ADDITIVE" and U.S. Provisional Patent Application No. 60/944,576, filed on 18 Jun. 2007, and entitled "FORMULATION FOR USE AS A FUEL OR FUEL ADDITIVE", which are incorporated herein by reference.

FIELD

Disclosed embodiments concern a fuel that can be used as a replacement for conventional fossil-based fuels. It can also be used as an additive to conventional fossil-based fuels, or alternative fuels.

BACKGROUND

Numerous formulations have been developed as alternative fuels to replace the conventional fossil-based fuels. An example of such a fuel is disclosed in Canadian patent 1340871, in which alcohol is mixed with ether and a lubricant such as mineral oil or a vegetable oil, such as castor oil. Formulations have also been developed for use as alternative fuels that combine renewable carbon sources such as alcohols with fossil fuels. An example of such a fuel is disclosed in Canadian patent 2513001, in which alcohol is mixed with naptha and an aliphatic ester. Similarly, U.S. Pat. No. 4,300,912 discloses a synthetic fuel formulation comprising naptha (20-60%), methanol (10-40%), butanol (20-40%) and a colloidal stabilizer that is prepared by heating the formulation in a reactor to a temperature of 300° Fahrenheit then passing the resulting vapors through a water cooled condenser and collecting the liquid fuel in a holding tank. U.S. Pat. No. 5,575,822 discloses a number of fuel and fuel additives. The fuels range from two component formulations, such as 10 to about 42% terpene, preferably limonene, and from about 1 to about 90% naphtha compound to more complex formulations such as 10 to about 16 w/w % limonene, from about 19 w/w % to about 45 w/w % aliphatic hydrocarbons having a flash point between 7° C., to about 24° C., most preferably Varnish Makers and Painters (VM&P) naptha, from about 20 w/w % to about 40% w/w % alcohol, most preferably methanol, from about 9 w/w % to about 36 w/w % surfactant, most preferably glycol ether EB and a preferred fuel comprising about 11.4 w/w % limonene, about 40.7 w/w % VM&P naptha, about 15.5 w/w % glycol ether EB, about 22 w/w % methanol, and about 10.6 w/w % castor oil. Such formulations require significant fuel delivery system modifications. Formulations using methanol degrade conventional fuel lines and seals, such as O rings. Furthermore methanol is corrosive and castor oil, when mixed with methanol, forms deposits within fuel injectors and carburetors that reduce the lifespan of the parts and lead to undue maintenance costs. Also, the relatively high flash point of VM&P naptha results in poor cold starts.

Whitworth's U.S. Pat. Nos. 4,818,250 and 4,915,707 describe a process for purifying limonene for use as a fuel or fuel additive. The process includes distillation of limonene-containing oil followed by removal of water. The distilled limonene, blended with an oxidation inhibitor such as p-phenylenediamine, is claimed as a gasoline extender when added in amounts up to 20% volume. Unfortunately, in actual testing under a power load in a dynamometer, addition of 20% limonene to unleaded 87 octane gasoline resulted in serious preignition, casting serious questions as to its practical value as a gasoline extender.

Terpenoid-based fuels have been disclosed in U.S. Pat. No. 5,186,722. Disclosed are a very wide range of terpenes, terpenoids and derivatives thereof, including limonenes, menthols, linalools, terpinenes, camphenes and carenes. The fuels are produced by a cracking/reduction process or by irradiation. Limonene was shown to produce 84% 1-methyl-4-(1-methylethyl) benzene by this process. While the fuel is superior to that of Whitworth, production costs are relatively high.

Eucalyptus oil was explored by Barton and coworkers as a fuel additive. Barton and Knight (1997, *Chemistry in Australia* 64 (1): 4-6) identified commercial solvents and Barton and Tjandra (1988, *Fluid phase eqilibria* 44:117-123, 1989, *Fuel* 68:11-17) identified stabilization of petroleum/ethanol fuel blends as potential uses for cineole (from eucalyptus oil). It functions as a co-solvent in fuel blends comprising polar and nonpolar components (petroleum and ethanol for example), thereby preventing phase separation. Cineole is the major component of eucalyptus oil, comprising about 80% of the oil. In other studies, eucalyptus oil was used as a fuel. Performance was very good except that there were problems starting a cold engine on straight eucalyptus oil, which could be readily overcome by adding 20 to 30% alcohol or gasoline.

Various vegetable oils have been added to fuel formulations to increase the lubricity value. For example, U.S. Pat. No. 5,730,029 discloses using peanut oil, and other oils having high (80%) oleic acid content, in two-stroke fuels. The combination of a high lubricity value and a high flash point allows for lubrication at high engine temperatures. The flame retarding characteristic of the oil assists in increasing power. U.S. Pat. No. 5,743,923 disclose using peanut oil in conjunction with an alcohol and a petroleum fractional distillate.

U.S. patent application Ser. No. 10/506,963 discloses a fuel additive that is an emulsifying composition that includes a selected ethoxylated alkylphenol, which functions as a surfactant, a fatty acid amide, naphtha and oleic acid. The preferred composition includes one part polyoxyethylene-nonylphenol, two parts coconut diethanolamide, two parts heavy naphtha and one part oleic acid, by volume. The invention also extends to a hydrocarbon fuel including the composition.

Despite the foregoing, a composition has not been provided that compares favourably to existing fuels with regard to horsepower and BTU output, for use in spark ignition engines (two stroke, four stroke and jet engines), in the absence of hardware or software modifications. It is an object to overcome the deficiencies of the prior art.

SUMMARY

Certain disclosed embodiments concern a composition for use as a fuel or fuel additive. For example, particular disclosed embodiments concern compositions that provide an alternative fuel and a fuel additive that compares favourably to existing fuels with regard to horsepower and torque, for use in spark ignition engines (two stroke and four stroke engines) in the absence of hardware or software modifications. By selecting the specific components and mixing them in defined ratios, the resulting composition, when combusted, reduces harmful emissions, while increasing gaseous oxygen emission, whether used alone or as a gas additive. Further, by selecting the specific components, a biofuel or fuel additive is provided that contains up to about 56% biologically derived components, all of which are readily renewable. Finally, the remaining about 44% can be produced with a minimum of refining.

In one embodiment the composition comprises mid flash point to low flashpoint naptha; at least one alcohol having a ratio of between about 1 to about 4 carbon atoms to 1 hydroxyl functional group (—OH); at least one lubricating oil; and at least one oxygenated natural aromatic compound, where the oxygenated natural aromatic compound:

(i) has a flash point between about 60° C. and about 160° C.;

(ii) has at least one oxygenated functional group; and (iii) is soluble in the composition.

In one aspect, the composition comprises from about 44% to about 71% v/v mid flash point to low flashpoint naptha, from about 10% to about 34% v/v alcohol, from about 0.5% to about 5% v/v lubricating oil, and from about 0.3% to 17% v/v oxygenated natural aromatic compound.

In another aspect, the at least one alcohol is selected from methanol, ethanol, propanol, isopropanol, butanol, isobutanol, tert-butanol and combinations thereof.

In another aspect, the at least one alcohol is:

(i) one of methanol or ethanol or a combination of methanol and ethanol; or (ii) one of butanol or isopropanol or a combination of butanol and isopropanol.

In another aspect, the oxygenated natural aromatic compound is selected from methyl salicylate, cinnamaldehyde, salicylic acid, eugenol, their analogues and derivatives, and combinations thereof.

In another aspect, the oxygenated natural aromatic compound is methyl salicylate.

In another aspect, the lubricating oil is a high flash point, high lubricity oil.

In another aspect, the high flash point, high lubricity oil is peanut oil.

In another aspect, the alcohol is methanol.

In another aspect, the alcohol is ethanol.

In another aspect, the composition comprises from about 44% to about 71% v/v mid flash point to low flashpoint naptha, from about 35% to about 40% v/v butanol or isopropanol or a mixture thereof, from about 0.5% to about 5% v/v lubricating oil, and from about 0.3% to 17% v/v oxygenated natural aromatic compound.

In another embodiment a composition for use as a fuel or fuel additive is provided, comprising:

a petroleum distillate having a flash point from about −22° C. to about −50° C. and comprised of at least one of short chain alkanes, paraffins and napthenes;

at least one alcohol having a ratio of between about 1 to about 4 carbon atoms to 1 hydroxyl functional group;

at least one lubricating oil; and at least one oxygenated natural aromatic compound, wherein the oxygenated natural aromatic compound (i) has a flash point between about 60° C. and about 160° C., (ii) has at least one oxygenated functional group, and (iii) is soluble in the composition.

In one aspect, the composition comprises:

from about 44% to about 71% v/v petroleum distillate;

from about 10% to about 34% v/v alcohol, wherein the alcohol is (i) one of methanol or ethanol or a combination of methanol and ethanol; or (ii) one of butanol or isopropanol or a combination of butanol and isopropanol;

from about 0.5% to about 5% v/v lubricating oil; and from about 0.3% to 17% v/v methyl salicylate, cinnamaldehyde, salicylic acid, eugenol, their analogues and derivatives, and combinations thereof.

In another aspect, the composition comprises about 59% v/v petroleum distillate, about 34% v/v methanol or ethanol or a combination thereof, about 0.5% v/v peanut oil, and about 6% v/v methyl salicylate.

In another aspect, the composition comprises from about 44% to about 71% v/v petroleum distillate, from about 35% to about 40% v/v butanol, isopropanol or a mixture thereof, from about 0.5% to about 5% v/v lubricating oil, and from about 0.3% to 17% v/v oxygenated natural aromatic compound.

In another embodiment, a composition for reducing nitrogen oxide emissions is provided, the composition comprising petroleum distillate, at least one C1 to C4 alcohol, at least one lubricating oil, and at least one oxygenated natural aromatic compound that:

(i) has a flash point between about 50° C. and about 160° C.;

(ii) has at least one oxygenated functional group; and (iii) is soluble in the composition.

In one aspect, the composition comprises from about 50% to about 70% v/v mid flash point naptha, from about 10% to about 45% v/v alcohol having a ratio of not less than about 14 carbon atoms to about 11 hydroxyl functional groups, from about 0.5% to about 2% v/v high flash point, high lubricity oil, and from about 3% to 10% v/v oxygenated natural aromatic compound. In another aspect, the composition comprises about 54% v/v mid flash point naptha, about 29% v/v methanol, about 0.5% v/v high flash point, high lubricity oil, about 10.5% v/v butanol or isopropanol, and about 6% v/v methyl salicylate.

In another aspect, the composition comprises about 54% v/v mid flash point naptha, about 29% v/v ethanol, about 0.5% v/v high flash point, high lubricity oil, about 10.5% v/v butanol or isopropanol, and about 6% v/v methyl salicylate.

In another aspect, the composition further comprises gasoline.

In another aspect, the gasoline comprises between from about 10% to about 90% v/v of the composition.

In another embodiment a method is provided, comprising:

(i) preparing a composition comprising mid flash point to low flash point naptha, alcohol, wherein the alcohol has a ratio of between about 1 to about 4 carbon atoms to 1 hydroxyl functional group, lubricating oil and an oxygenated natural aromatic compound;

(ii) blending the composition with about 0% to about 90% v/v gas to prepare a fuel; and (iii) operating a motor using the fuel.

In one aspect of the method, the at least one oxygenated natural aromatic compound (i) has a flash point between about 60° C. and about 160° C., (ii) has at least one oxygenated functional group, and (iii) is soluble in the composition.

In another embodiment, a composition for use as a fuel or a fuel additive is provided, the composition comprising mid flash point to low flashpoint naptha, at least one alcohol having a ratio of between about 1 to about 4 carbon atoms to 1 hydroxyl functional group, at least one high flash point, high lubricity oil, and methyl salicylate, wherein the naptha and the alcohol comprise from about 88% to about 96% v/v of the composition.

In another embodiment, a method is provided, comprising:

(i) providing a composition comprising a petroleum distillate having a flash point of no higher than −22° C., at least one alcohol having a ratio of between about 1 to about 4 carbon atoms to 1 hydroxyl functional group, at least one high flash point, high lubricity oil, and at least one component that is a combined co-solvent, flame front retarder, and anti-corrosive agent; and (ii) using the composition as a fuel.

In one aspect of the method, the composition is further defined as comprising from about 50% to about 70% v/v of the petroleum distillate, from about 20% to about 35% v/v of the alcohol, from about 0.3% to about 2% v/v high flash point, high lubricity oil, and from about 3% to 6% v/v of a component that is a combined co-solvent, flame front retarder, and anti-corrosive agent.

In another aspect of the method, the composition comprises about 54% v/v mid flash point naptha, about 29% v/v methanol, about 10.5% isopropanol or butanol, about 0.5% v/v peanut oil, and about 6% v/v methyl salicylate.

In another aspect of the method, the composition comprises about 54% v/v mid flash point naptha, about 29% v/v ethanol, about 10.5% isopropanol or butanol, about 0.5% v/v peanut oil, and about 6% v/v methyl salicylate.

In another aspect of the method, the composition comprises about 45% v/v butanol.

In another aspect of the method, the composition comprises about 45% v/v isopropanol.

In another embodiment, a method is provided comprising:

providing a composition comprising naptha having a flash point of no higher than −22° C., at least one alcohol having a ratio of between about 1 to about 4 carbon atoms to 1 hydroxyl functional group, at least one high flash point, high lubricity oil, and at least one component that is a combined co-solvent, flame front retarder, and anti-corrosive agent; and using the composition as a fuel.

In one aspect of the method, the composition comprises from about 50% to about 70% v/v mid to low flash point naptha, from about 20% to about 35% v/v of the alcohol, from about 0.3% to about 2% v/v high flash point, high lubricity oil, and from about 3% to about 6% v/v component that is a combined co-solvent, flame front retarder, and anti-corrosive agent.

In another aspect of the method, the composition further comprises about 10.5% v/v butanol.

In another aspect of the method, the composition further comprises about 10.5% v/v isopropanol.

DETAILED DESCRIPTION

I. Definitions

The following definitions are provided solely to aid the reader. These definitions should not be construed to provide a definition that is narrower in scope than would be apparent to a person of ordinary skill in the art.

A. High lubricity oil: Lubricity is determined by mixing 4 mL in 996 mL fuel, fueling a 950 watt, two stroke generator motor designed to run on oil and fuel, running the engine at 4,200 RPMS at maximum load for four and one half hours, measuring the compression ratio, and assessing ring stick and scoring of the cylinder walls of the engine. A high lubricity oil is defined as one that does not lead to a reduction in compression ratio, does not create "ring stick" and does not allow scoring under the test conditions.

B. High flash point oil: A high flash (FP) point oil is defined as one having a flash point of about 204° C. (400° F.) to about 343° C. (650° F.), more preferably from about 260° C. (500° F.) to about 288° C. (55° F.), and still more preferably about 282° C. (540° F.). The following is a non-exhaustive list of oils that would be known to be high flash point lubricating oils: Canola oil, Coconut oil, Corn oil, Flax seed oil, Olive oil, Peanut oil, Safflower oil, Sesame oil, Soybean oil, Sunflower oil, and Rapeseed oil. Selected mineral oils also have suitably high flash points.

C. High flash point, high lubricity oil: In a present working example, peanut oil is added to the composition. Peanut oil's major component fatty acids are palmitic acid (comprising approximately 1-14%), oleic acid (comprising approximately 36-67%), and linoleic acid (comprising approximately 14-46%). An oleic acid content of from about 30% to about 80% provides an acceptable lubricity value, a more acceptable value is obtained with an oleic acid content of from about 40% to about 70% and a still more acceptable value is obtained with an oleic acid content of from about 65% to about 70%. Other long chain fatty acids also provide suitable lubricity values, as would be known to a person of ordinary skill in the art.

D. Co-solvent: Any compound, which when added to a naptha/alcohol mixture allows the polar alcohol component to mix with the non-polar naptha component. The oxygenated natural aromatic compounds can function as a co-solvent. Cyclic, heterocyclic compounds, including furans, such as tetrahydrofuran (THF), frequently have been added to compositions as a co-solvent. It would be known that co-solvents such as THF can be replaced with selected cyclic ethers, including the dioxanes, ethylene oxide, trimethyloxide and tetrahydropyran. Of these, the dioxanes have a miscibility in water that is similar to that for THF. Substitution of the oxygen for other elements, such as sulfur, also provides suitable co-solvents, such as tetrahydropyrrole (pyrrolidine), tetrahydrothiophene, tetrahydroselenophene and tetrahydrotellurophene. Pyrrolidine would be known to be useful as a replacement of THF, as it is miscible in water. Tetrahydrothiophene would similarly be useful, however, it has a foul odour E. Oxygenated natural aromatic compound: Any compound that is a natural product—a product that can be, for example, but not limited to, extracted from a plant, and has at least one hydroxyl, carboxylic acid, aldehyde, ketone, ether or ester functional group, or any and all combinations thereof, coupled to an aromatic ring system, such as a benzene ring, including a substituted benzene ring. The flash point is preferably between from about 60° C. and about 160° C., more preferably between about 90° C. and 110° C. and most preferably 101° C. Without being limited to a theory of operation, it currently is believed that oxygenated natural aromatic compounds, in addition to other compounds, as would be known to one skilled in the art, function as combined flame front retarders, anti-corrosive agents and co-solvents. Oxygenated natural aromatic compounds include, but are not limited to, methyl salicylate, eugenol, salicylic acid, cinnamaldehyde, thymol, benzaldehyde, salicylaldehyde, eugenol and their synthetic or natural analogues and derivatives. The currently preferred oxygenated natural aromatic compound is methyl salicylate.

F. Alcohol: Alcohols in the present working examples typically are lower alkyl alcohols, such as C1 to C4 alcohols, more specifically methanol, ethanol (95% ethanol), isopropanol, and butanol. As would be known to a person of ordinary skill in the art, other alcohols that are suitable for the present invention include, for example, but not limited to propanol, amyl alcohol, and isoamyl alcohol. The ratio of carbon atoms to hydroxyl functional group should preferably be about 4-to-1, more preferably 3-to-1, and most preferably 2-to 1 or 1-to-1, to promote solubility in an aqueous environment and to promote miscibility between the polar and non-polar components of the composition. It would be further known to a person of ordinary skill in the art, that any alcohol or mixture of alcohols providing a ratio of between about 1 carbon to about 1 hydroxyl functional group and about 4 carbon to about 1 hydroxyl functional group would be suitable.

G. Mixture A: Mixture A comprises about 78% oxygenated natural aromatics, including methyl salicylate, cinnamaldehyde, and eugenol.

H. Oil of wintergreen: Oil of wintergreen is methyl salicylate. Without being limited to a theory of operation, it currently is believed that methyl salicylate functions as a combined flame front retarder, anti-corrosive agent and co-solvent. The product is available from ROUGIER PHARMA (DIN 00336211).

I. Low Flash Point Naptha: Naphtha is a group of various volatile flammable liquid hydrocarbon mixtures used primarily as feedstocks in refineries for the reforming process and in the petrochemical industry for the production of olefins in steam crackers. It is also used in solvent applications in the chemical industry. Low flash point naptha is low in paraffins, napthenes and aromatic hydrocarbons. It is predominantly short chain alkanes, preferably C5 and C6 alkanes, more preferably predominately C5 alkanes, and most preferably comprising from about 60% v/v to about 70% v/v C5 alkanes. It may also be known as petroleum ether. Naptha in the present context, for use in gas-powered engines, has a flash-point of no greater than about −35° C., and more preferably between about −40° C. and about −50° C.

J. Mid-Flash Point Naptha: Mid flash point naptha in the present context, for use in gas-powered engines, has a flash-point of no greater than about −22° C., and more preferably between about −25° C. and about −35° C. and is composed of from about 50% v/v to about 99% v/v paraffins and napthenes, with no greater than about 5% v/v aromatic hydrocarbons, preferably from about 85% v/v to about 99% v/v paraffins and napthenes, with no greater than about 2% v/v aromatic hydrocarbons, and most preferably from about 90% v/v to about 98% v/v paraffins and napthenes with no greater than 1.5% v/v aromatic hydrocarbons. The following is a non-exhaustive list of terms that refer to materials that would include naptha as defined for use with the present invention:

White gas
Coleman™ fuel
Shellite
Middle distillates
Petroleum distillates

K. Mid Flash Point to Low Flash Point Naptha: Any naptha having a flashpoint of no higher than about −22° C., and typically having a flash point from a high of about −22° C. to a low of at least about −50° C., and can range from 100% low flash point naptha to 100% mid flash point naptha.

L. High Flash Point Naptha: High Flash point naptha, in the present context can include VM&P naptha. High flash point naptha has a flash point in the range of from about 7° C. to about 24° C.

M. Petroleum distillate: Petroleum distillate in the present context is any distillate of petroleum that has a flash point from about −22° C. to about −50° C. and is comprised of at least one of short chain alkanes (up to about 12 carbons), paraffins and napthenes. Preferably, there is no greater than about 5% v/v aromatic hydrocarbons.

II. Description

An alcohol-based fuel composition has been developed, exemplified in working embodiments by butanol, isopropanol, ethanol and methanol-based fuel compositions, which have been developed and tested. Unless otherwise noted, the percentage of each component is on the basis of v/v, regardless of whether the component is liquid or solid. FIG. 1 shows the general formulae. It is a flexible fuel, with a plug-in alcohol component. This allows it to be a replacement fuel for 87 octane gas, for use in carbureted engines, and an 89 octane fuel and 91 octane fuel for use in fuel injected engines.

The following table outlines the working range of components contemplated.

| | Naphtha (Low or mid-flash point) | Alcohol | Peanut Oil | Mixture A and/or methyl salicylate |
|---|---|---|---|---|
| Working range | 44-71% | 10-45% | 1-2% | 0.25%-17% |

Example 1

The composition used is shown in the following table:

| | Low flash point naptha | Isopropanol | Peanut oil | Mixture A | Methyl salicylate |
|---|---|---|---|---|---|
| Volume | 178 | 67 | 1 | 2 | 3 |
| % (v/v) | 71 | 27 | 0.3 | 0.7 | 1 |

Testing by the Industrial Support Fuels and Lubricants Group at the Alberta Research Council provided the following data:

| Sample | 1 | 2 | 3 | Mean |
|---|---|---|---|---|
| Density kg/m$^3$ @ 15° C. | 738.7 | 747.2 | 751.5 | 745.8 |
| Octane number, motor | 82.0 | 82.4 | 82.4 | 820.3 |
| Octane number, research | 87.8 | 88.4 | 88.5 | 88.2 |
| Sulphur, ppm μg/g | <1 | <1 | <1 | <1 |
| Antiknock index | 84.9 | 85.4 | 85.4 | 85.2 |
| Copper corrosion (3 hr @ 50° C.) | 1a | 1a | 1a | 1a |
| Residue (%) after distillation | 1.2 | 1.4 | 1.4 | 1.3 |
| Driveability index | 406 | 412 | 411 | 408 |
| Oxidation stability, minutes | >240 | >240 | >240 | >240 |
| Vapour pressure kPa | 25.4 | 23.9 | 24.1 | 24.5 |

A Zeltex™ octane analyzer reading provided a research octane number of 93.5 and a motor octane number of 85.8. AirCare™ testing was also carried out. The same car was tested under the same operating conditions. The results follow:

| | rpm | CH ppm | CO % | $O_2$ % | $CO_2$ % | NO*x* ppm |
|---|---|---|---|---|---|---|
| gasoline | 750 | 228 | 1.05 | 1.7 | 4.3 | 76 |
| present embodiment | 750 | 0 | .02 | .6 | 4.1 | 6 |
| gasoline | 2000 no load | 105 | 1.23 | 1.2 | 4.3 | 195 |
| present embodiment | 2000 no load | 0 | .12 | .4 | 4.1 | 26 |
| gasoline | 2100 loaded | 2 | .27 | 0 | 4.7 | 1452 |

-continued

| | rpm | CH ppm | CO % | $O_2$ % | $CO_2$ % | NOx ppm |
|---|---|---|---|---|---|---|
| present embodiment | 2100 loaded | 2 | .17 | 0 | 4.2 | 1258 |
| gasoline | 2000 cruise | 0 | .29 | .1 | 4.7 | 1011 |
| present embodiment | 2000 cruise | 1 | .25 | .1 | 4.2 | 917 |
| gasoline | 3000 loaded | 0 | .39 | 0 | 4.5 | 1956 |
| present embodiment | 3000 loaded | 3 | .23 | 0 | 4.2 | 717 |

Example 2

M7.5:gas mixes were tested against gas on a 1987 Honda 1600 engine. This engine was chosen as one of the more reliable and commonly-used engines in the four-cylinder automobile line. It was not overhauled although it is well broken-in with more than 26,000 kilometers of use. All pollution controls such as a catalytic converter were removed.

The octane was determined using a Zeltex™ octane analyzer. Emissions were measured in real-time using a Ferret™ emissions tester. The emissions from samples were collected in parallel with testing of the formulae and analyzed by gas chomatography-mass spectroscopy and Fourier Transform Infra Red spectroscopy. The results show an absence of ozone, an absence of aromatics and an absence of formaldehyde. Of the emissions, only the presence of methyl nitrite was remarkable.

M7.5

| Component | Percentage |
|---|---|
| Naptha (mid flash point) | 54 |
| Methanol | 29 |
| Peanut oil | .4 |
| Isopropanol | 10.5 |
| Oil of Wintergreen | 6 |

Octane: 93.5
M7.5:gas 50:50

| RPM | torque | HP | HC | CO | O2 | CO2 | NOX | run time[1] |
|---|---|---|---|---|---|---|---|---|
| 2500 | 115 | 23 | 29.3 | .08 | 5.53 | 10.63 | 720 | 10.76 |

| | HC | CO | O2 | CO2 | NOX | run time[1] |
|---|---|---|---|---|---|---|
| Percent[2] | 126 | 127 | 170 | 86 | 25 | 99 |
| Corrected[3] | 126 | 127 | 170 | 86.6 | 25 | 100 |

[1]run time in minutes/L
[2]Percent of gas emissions
[3]Percent of gas emissions corrected to 100% run time of gas M7.5:gas 75:25

| RPM | torque | HP | HC | CO | O2 | CO2 | NOX | run time[1] |
|---|---|---|---|---|---|---|---|---|
| 2500 | 113 | 22 | 42.6 | .083 | 6.2 | 10 | 313 | 10.08 |

| | HC | CO | O2 | CO2 | NOX | run time[1] |
|---|---|---|---|---|---|---|
| Percent[2] | 103 | 132 | 190 | 81 | 11 | 93 |
| Corrected[3] | 110 | 142 | 204 | 87 | 11.5 | 100 |

[1]run time in minutes/L
[2]Percent of gas emissions
[3]Percent of gas emissions corrected to 100% run time of gas

Example 3

M7.5B was tested against 89 and 92 octane gas on a 1987 Honda 1600 engine. This engine was chosen as one of the more reliable and commonly-used engines in the four-cylinder automobile line. It was not overhauled although it is well broken-in with more than 26,000 kilometres of use. All pollution controls such as a catalytic converter were removed.

The octane was determined using a Zeltex octane analyzer. Emissions were measured in real-time using a Ferret emissions tester. The emissions from samples were collected in parallel with testing of the formulae and analyzed by gas chomatography-mass spectroscopy and Fourier Transform Infra Red spectroscopy. The results show an absence of ozone, an absence of aromatics and an absence of formaldehyde. Of the emissions, only the presence of methyl nitrite was remarkable.

M7.5B

| Component | Percentage |
|---|---|
| Naptha (mid flash point) | 54 |
| Methanol | 29 |
| Peanut oil | .4 |
| Butanol | 10.5 |
| Oil of Wintergreen | 6 |

| RPM | torque | HP | HC | CO | $O_2$ | $CO_2$ | NOX | run time[1] |
|---|---|---|---|---|---|---|---|---|
| 2500 | 118 | 23 | 116 | .08 | 5.7 | 10.5 | 152 | 11.24 |

| | HC | CO | $O_2$ | $CO_2$ | NOX | run time[1] |
|---|---|---|---|---|---|---|
| Percent[2] | 100 | 109 | 259 | 79 | 5.5 | 89 |
| Corrected[3] | 112 | 122 | 291 | 89 | 6 | 100 |

[1]run time in minutes/L
[2]Percent of gas emissions
[3]Percent of gas emissions corrected to 100% run time of gas The emissions from samples were collected in parallel with testing of the formulae and analyzed by gas chomatography-mass spectroscopy and Fourier Transform Infra Red spectroscopy. The results show an absence of ozone, an absence of aromatics and an absence of formaldehyde. Of the emissions, only the presence of methyl nitrile was remarkable.

Example 4

| M7.5B | |
|---|---|
| Component | Percentage |
| Naptha (mid flash point) | 54 |
| Methanol | 29 |
| Peanut oil | .4 |
| Butanol | 10.5 |
| Oil of Wintergreen | 6 |

Octane: 89.9

A road test conducted on Terraline™ M with the butanol plug-in (M7.5B) demonstrated that the car ran normally. The vehicle, a Chrysler minivan (fuel injection engine) was first driven on a course that included a 50 km zone, stop signs, a 90 km zone, and a stop light, using 87 octane gas. The gas was pumped from the system, leaving no more than an estimated 0.5 L in the system. Over 10 L of M7.5B was then put in the system. The car started normally. It was then tested over the same driving conditions, with the exception that it was driven further down the highway and acceleration at highway speed was tested by flooring the accelerator, in addition to standard driving away from a stop light. The driver reported that the driveability of the fuel was the same as that of gas.

Example 5

Other compositions were tested, as follows:

| M21 | |
|---|---|
| Component | Percentage |
| Naptha (mid flash point) | 59 |
| Methanol | 34 |
| Peanut oil | .4 |
| Butanol | — |
| Oil of Wintergreen | 6 |

Ran very lean in a carbureted engine and had low emissions, but lower power than M7.5B or M7.5.

| M33 | |
|---|---|
| Component | Percentage |
| Naptha (low flash point) | 70 |
| Methanol | 23 |
| Peanut oil | .4 |
| Butanol | — |
| Oil of Wintergreen | 6 |

Ran very rich in a carbureted engine and had higher emissions than M7.5B or M7.5.

| M32 | |
|---|---|
| Component | Percentage |
| Naptha (low flash point) | 59 |
| Methanol | 34 |
| Peanut oil | .4 |
| Cinnamaldehyde | 6 |

Ran as well as M7.5B, with comparable emissions to M7.5B and M7.5.

| M21-W + Mixture A | |
|---|---|
| Component | Percentage |
| Naptha (mid or low flash point) | 59 |
| Methanol | 34 |
| Peanut oil | .4 |
| Butanol | — |
| Mixture A | 6 |

The results were essentially the same as that for M21.

| M34 | |
|---|---|
| Component | Percentage |
| Naptha (mid flash point) | 59 |
| Methanol | 34 |
| Peanut oil | .4 |
| Butanol | — |
| Methyl salicylate | 6 |

The results were essentially the same as that for M21 in a carbureted engine, although it ran very lean.

| M10 | |
|---|---|
| Component | Percentage |
| Naptha (low flash point) | 56 |
| Methanol | 24 |
| Peanut oil | .4 |
| Isopropanol | 10.5 |
| Methyl salicylate | 6 |

Ran very well on a carbureted engine.

| M3 | |
|---|---|
| Component | Percentage |
| Naptha (low flash point) | 52 |
| Methanol | 34 |
| Peanut oil | 1 |
| Isopropanol | 7 |
| Methyl salicylate | 6 |

Ran very well on a carbureted engine.

Example 6

| M15 | |
|---|---|
| Component | Percentage |
| Naptha (Low flash point) | 62 |
| Methanol | 27 |
| Peanut oil | .4 |
| Isopropanol | 11 |

| | HC | CO | O2 | CO2 | NOX |
|---|---|---|---|---|---|
| Percent of Gas | 50 | 128 | 156 | 89 | 65 |

Emissions were higher than compositions containing Mixture A or methyl salicylate, or cinnamaldehyde. Corrosion was tested in a corrosion test using standard carburetor parts. There was no noticeable corrosion.

Example 7

Ethanol compositions were tested on a fuel injected engine. The testing included an 87 octane gas sample at the beginning of the testing.

| GAS | |
|---|---|
| HC | 5 |
| CO | .05 |
| CO2 | 10.4 |
| O2 | 1.6 |
| NOX | 3900 |
| Rpm | 2500 |
| Torque | 163 |
| Horsepower | 32 |

| E21 | |
|---|---|
| Component | Percentage |
| Naptha (mid FP) | 59.6 |
| Ethanol (95%) | 34 |
| Peanut oil | .4 |
| Oil of Wintergreen | 6 |

Could not be tested as the polar and non-polar components were not miscible.

| E40B | |
|---|---|
| Component | Percentage |
| Naptha (mid FP) | 59.6 |
| Ethanol (95%) | 24 |
| Peanut oil | .4 |
| Butanol | 10 |
| Mixture A | 6 |

-continued

| E40B | |
|---|---|
| Component | Percentage |
| HC | 3 |
| CO | .08 |
| CO2 | 9.2 |
| O2 | 2200 |
| NOX | 2500 |
| Rpm | 2500 |
| Torque | 150 |
| Horsepower | 30 |

| E41B | |
|---|---|
| Component | Percentage |
| Naptha (mid FP) | 64.6 |
| Ethanol (95%) | 24 |
| Peanut oil | .4 |
| Butanol | 5 |
| Mixture A | 6 |
| HC | 5 |
| CO | .07 |
| CO2 | 9.3 |
| O2 | 3.6 |
| NOX | 2400 |
| Rpm | 2500 |
| Torque | 150 |
| Horsepower | 30 |

| E42B | |
|---|---|
| Component | Percentage |
| Naptha (mid FP) | 54.6 |
| Ethanol (95%) | 24 |
| Peanut oil | .4 |
| Butanol | 15 |
| Oil of Wintergreen | 6 |
| HC | 0 |
| CO | .07 |
| CO2 | 9.1 |
| O2 | 3.8 |
| NOX | 2100 |
| Rpm | 2500 |
| Torque | 134 |
| Horsepower | 28 |

The power output was lower than for the other compositions.

| E43B | |
|---|---|
| Component | Percentage |
| Naptha (mid FP) | 54.6 |
| Ethanol (95%) | 29 |
| Peanut oil | .4 |
| Isopropanol | |
| Butanol | 10 |
| Oil of Wintergreen | 6 |
| HC | 1 |
| CO | .07 |
| CO2 | 9.1 |
| O2 | 4.1 |
| NOX | 2000 |

-continued

| E43B | |
|---|---|
| Component | Percentage |
| Rpm | 2500 |
| Torque | 133 |
| Horsepower | 27 |

Power was low.

Example 8

Further testing involved selecting one ethanol composition and testing it against 87 octane gas in order to determine emissions, run time, and then emissions corrected for run time:

| GAS | |
|---|---|
| HC | 12 |
| CO | .41 |
| CO2 | 9.9 |
| O2 | 1.2 |
| NOX | 3300 |
| Rpm | 2500 |
| Torque | 150 |
| Horsepower | 30 |
| Run time | 8.03 min/L |

| E7.5B hybrid | |
|---|---|
| Component | Percentage |
| Naptha (mid FP) | 54 |
| Ethanol | 29 |
| Peanut oil | .4 |
| Butanol | 10.5 |
| Oil of Wintergreen | 6 |

| | | Corrected for run time |
|---|---|---|
| HC | 0 | 0 |
| CO | .08 | .087 |
| CO2 | 8.2 | 8.98 |
| O2 | 4.2 | 4.6 |
| NOX | 2060 | 2256 |
| Rpm | 2500 | |
| Torque | 153 | |
| Horsepower | 30 | |
| Run time | 7.33 min/L (91.3% of gas) | |

Example 9

An isopropanol composition was tested on the fuel injected engine as follows:

| GAS | |
|---|---|
| HC | 12 |
| CO | .41 |

-continued

| GAS | |
|---|---|
| CO2 | 9.9 |
| O2 | 1.2 |
| NOX | 3300 |
| Rpm | 2500 |
| Torque | 150 |
| Horsepower | 30 |
| Run time | 8.03 min/L |

| I7.5B hybrid | |
|---|---|
| Component | Percentage |
| Naptha (mid FP) | 54 |
| Isopropanol | 29 |
| Peanut oil | .4 |
| Butanol | 10.5 |
| Oil of Wintergreen | 6 |

| | | Corrected for run time |
|---|---|---|
| HC | 0 | 0 |
| CO | .06 | .064 |
| CO2 | 8.5 | 9.06 |
| O2 | 3.8 | 4.05 |
| NOX | 2500 | 2665 |
| Rpm | 2500 | |
| Torque | 154 | |
| Horsepower | 30 | |
| Run time | 7.53 min/L (93.8% of gas) | |

Example 10

A butanol composition was tested on a fuel injected engine. The testing included an 87 octane gas sample at the beginning of the testing.

| GAS | |
|---|---|
| HC | 5 |
| CO | .05 |
| CO2 | 10.4 |
| O2 | 1.6 |
| NOX | 3900 |
| Rpm | 2500 |
| Torque | 163 |
| Horsepower | 32 |

| B10B | |
|---|---|
| Component | Percentage |
| Naptha (mid FP) | 54 |
| Butanol | 39.5 |
| Peanut oil | .4 |
| Oil of Wintergreen | 6 |
| HC | 3 |
| CO | .05 |

-continued

| B10B | |
|---|---|
| Component | Percentage |
| CO2 | 9.2 |
| O2 | 3.7 |
| NOX | 2700 |
| Rpm | 2500 |
| Torque | 163 |
| Horsepower | 32 |

Example 11

The engine was modified to include a water injection system (TECTANE H2O Injector) and the performance of the fuels was then assessed.

| GAS | INJECTOR OFF | INJECTOR ON |
|---|---|---|
| HC | 0 | 0 |
| CO | .19 | .36 |
| CO2 | 9.9 | 10.1 |
| O2 | 1.2 | .9 |
| NOX | 3400 | 2500 |
| Rpm | 2500 | 2500 |
| Torque | 150 | 154 |
| Horsepower | 30 | 30 |

| M7.5B hybrid | |
|---|---|
| Component | Percentage |
| Naptha (mid FP) | 54 |
| Methanol | 29 |
| Peanut oil | .4 |
| Butanol | 10.5 |
| Oil of Wintergreen | 6 |

| | INJECTOR OFF | INJECTOR ON |
|---|---|---|
| HC | 0 | 0 |
| CO | .09 | .1 |
| CO2 | 8.2 | 8.4 |
| O2 | 4.3 | 3.6 |
| NOX | 1900 | 1200 |
| Rpm | 2500 | 2500 |
| Torque | 150 | 155 |
| Horsepower | 30 | 30 |

| E7.5B hybrid | |
|---|---|
| Component | Percentage |
| Naptha (mid FP) | 54 |
| Ethanol | 29 |
| Peanut oil | .4 |
| Butanol | 10.5 |
| Oil of Wintergreen | 6 |

| | INJECTOR OFF | INJECTOR ON |
|---|---|---|
| HC | 0 | 0 |
| CO | .09 | .09 |
| CO2 | 8.2 | 8.6 |
| O2 | 4.0 | 3.4 |
| NOX | 2100 | 1300 |
| Rpm | 2500 | 2500 |
| Torque | 156 | 154 |
| Horsepower | 31 | 30 |

| I7.5B hybrid | |
|---|---|
| Component | Percentage |
| Naptha (mid FP) | 54 |
| Isopropanol | 29 |
| Peanut oil | .4 |
| Butanol | 10.5 |
| Oil of Wintergreen | 6 |

| | INJECTOR OFF | INJECTOR ON |
|---|---|---|
| HC | 0 | 0 |
| CO | .09 | .08 |
| CO2 | 8.6 | 8.7 |
| O2 | 3.4 | 3.0 |
| NOX | 2400 | 1900 |
| Rpm | 2500 | 2500 |
| Torque | 154 | 155 |
| Horsepower | 39 | 30 |

Example 12

A range of oxygenated natural aromatic compounds were tested using one selected composition as follows:

| GAS | |
|---|---|
| HC | 50 |
| CO | .09 |
| CO2 | 10.8 |
| O2 | 1.5 |
| NOX | 3500 |
| Rpm | 2500 |
| Torque | 150 |
| Horsepower | 30 |

| M7.5B hybrid | |
|---|---|
| Component | Percentage |
| Naptha (mid FP) | 54 |
| Methanol | 29 |
| Peanut oil | .4 |
| Butanol | 10.5 |
| Oil of Wintergreen | 6 |
| HC | 1 |
| CO | .08 |
| CO2 | 9.0 |
| O2 | 4.0 |
| NOX | 1800 |

-continued

| M7.5B hybrid | |
|---|---|
| Component | Percentage |
| Rpm | 2500 |
| Torque | 150 |
| Horsepower | 30 |

| M7.5B hybrid eugenol | |
|---|---|
| Component | Percentage |
| Naptha (mid FP) | 54 |
| Methanol | 29 |
| Peanut oil | .4 |
| Butanol | 10.5 |
| Eugenol | 6 |
| HC | 8 |
| CO | .12 |
| CO2 | 9.1 |
| O2 | 4.0 |
| NOX | 1800 |
| Rpm | 2500 |
| Torque | 150 |
| Horsepower | 30 |

| M7.5B hybrid cinnamaldehyde | |
|---|---|
| Component | Percentage |
| Naptha (mid FP) | 54 |
| Methanol | 29 |
| Peanut oil | .4 |
| Butanol | 10.5 |
| cinnamaldehyde | 6 |
| HC | 7 |
| CO | .1 |
| CO2 | 9.1 |
| O2 | 4.3 |
| NOX | 1500 |
| Rpm | 2500 |
| Torque | 150 |
| Horsepower | 30 |

Example 13

Emissions and run times were assessed on a select number of formulations. The results were used to assess the utility of each oxygenated natural aromatic compound in the various fuel compositions.

| GAS | |
|---|---|
| HC | 82 |
| CO | .18 |
| CO2 | 10.7 |
| O2 | 2.5 |
| NOX | 2900 |
| Rpm | 2500 |
| Torque | 150 |
| Horsepower | 30 |
| Run time | |

| M7.5B hybrid | |
|---|---|
| Component | Percentage |
| Naptha (mid FP) | 54 |
| Methanol | 29 |
| Peanut oil | .4 |
| Butanol | 10.5 |
| Oil of Wintergreen | 6 |

| | | Corrected for run time |
|---|---|---|
| HC | 55 | 65 |
| CO | .06 | .07 |
| CO2 | 7.8 | 9.2 |
| O2 | 5.3 | 6.2 |
| NOX | 1600 | 1880 |
| Rpm | 2500 | |
| Torque | 150 | |
| Horsepower | 30 | |
| Run time | 6.75 min/L 85% of gas | |

| M7.5B hybrid eugenol | |
|---|---|
| Component | Percentage |
| Naptha (mid FP) | 54 |
| Methanol | 29 |
| Peanut oil | .4 |
| Butanol | 10.5 |
| Eugenol | 6 |

| | | Corrected for run time |
|---|---|---|
| HC | 26 | 32 |
| CO | .11 | .13 |
| CO2 | 8.4 | 10.4 |
| O2 | 4.4 | 5.4 |
| NOX | 1500 | 1975 |
| Rpm | 2500 | |
| Torque | 150 | |
| Horsepower | 30 | |
| Run time | 6.42 min/L 81% of gas | |

| M7.5B hybrid salicylic acid | |
|---|---|
| Component | Percentage |
| Naptha (mid FP) | 54 |
| Methanol | 29 |
| Peanut oil | .4 |
| Butanol | 10.5 |
| Salicylic acid (solid) | 6 |

| | | Corrected for run time |
|---|---|---|
| HC | 17 | 20.5 |
| CO | .07 | .084 |

-continued

| | | Corrected for run time |
|---|---|---|
| CO2 | 7.8 | 9.4 |
| O2 | 5.2 | 6.3 |
| NOX | 1000 | 1200 |
| Rpm | 2500 | |
| Torque | 150 | |
| Horsepower | 30 | |
| Run time | 6.6 min/L 83% of gas | |

Example 14

A number of compositions were prepared and tested in order to assess the percentage range of each component that could be used. First it was noted that mid flash point naptha could be used interchangeably, or any mixture of the two could also be used. Accordingly, it was thought that any petroleum distillate that has a flash point from about −22° C. to about −50° C. and is comprised of at least one of short chain alkanes, paraffins and napthenes can also replace naptha. This was studied by replacing the napthas with 87 octane gasoline. Although gasoline is known to contain many additives, the bulk of a typical gasoline consists of hydrocarbons with between 5 and 12 carbon atoms per molecule, and therefore the bulk of a typical gasoline can be considered to be a petroleum distillate. The composition of the fuel and the results were as follows:

| Gasoline 7.5B | |
|---|---|
| Component | Percentage |
| 87 Octane Gas | 54 |
| Methanol | 29 |
| Peanut oil | .4 |
| Butanol | 10.5 |
| Methyl salicylate | 6 |
| HC | 22 |
| CO | .10 |
| CO2 | 9.9 |
| O2 | 4.0 |
| NOX | 2245 |
| Rpm | 2500 |
| Torque | 146 |
| Horsepower | 28 |

In comparison, gas produced the following test results:

| GAS | |
|---|---|
| HC | 82 |
| CO | .18 |
| CO2 | 10.7 |
| O2 | 2.5 |
| NOX | 2900 |
| Rpm | 2500 |
| Torque | 150 |
| Horsepower | 30 |

Although the advantage of the composition was not as great as that using napthas in the composition, there was still a 72% reduction in hydrocarbons, a 45% reduction in carbon monoxide, a 7% reduction in carbon dioxide, a 60% increase in oxygen and a 23% reduction in NOx. It was noted that the engine did not run smoothly and the fuel consumption was high, even though the power output was low. It was concluded that any petroleum distillate that has a flash point from about −22° C. to about −50° C. and is comprised of at least one of short chain alkanes, paraffins and napthenes can replace naptha.

Compositions having little or no alcohol could be used as fuels, however, the emissions were not significantly better than the emissions from gasoline. The minimum alcohol content needed to provide a significant reduction in emissions was about 20%, however, as little as 10% alcohol still provided some advantage. The maximum alcohol content was about 45%.

Methanol-based fuels tested ranged from about 23% methanol to about 34% methanol. Blending methanol with isopropanol or butanol allowed the alcohol content to be as high as about 45% (about 35% methanol and about 10% isopropanol or butanol). Note that blending in this context simply refers to preparing a composition that contains both methanol and isopropanol or butanol. If low flash point naptha was used, the methanol content could be increased to about 37% in the presence of about 5% isopropanol or butanol. Also, it would be known that any combination of butanol and isopropanol could be used with methanol to provide essentially the same results.

Ethanol-based fuels tested ranged from about 16% ethanol to 34% ethanol. Blending ethanol with isopropanol or butanol allowed the alcohol content to be as high as 42% (about 34% ethanol and about 8% isopropanol or butanol). Note that blending in this context simply refers to preparing a composition that contains both ethanol and isopropanol or butanol. Also, it would be known that any combination of butanol and isopropanol could be used with ethanol to provide essentially the same results. It would also be known that any combination of ethanol and methanol, wherein the combined percentage ranged from about 16% to about 34%, could be used with isopropanol or butanol or both to provide essentially the same result.

Isopropanol-based fuels tested ranged from about 27% to about 40% isopropanol. Similarly, butanol-based fuels containing up to about 40% butanol were tested. It would be known that any combination of isopropanol and butanol could be used to provide essentially the same results.

The naptha content in the various fuel compositions tested ranged from 44% to about 71%. Higher naptha content could be used, however the advantage over gas with regard to emissions diminished as the naptha content increased.

The content of oxygenated aromatic compounds tested ranged from a low of 0.25% to a high of about 17%. Isopropanol-based fuels lacking oxygenated aromatic compounds were useable as fuels, however the fuels were corrosive. Similar results would be expected for butanol-based fuels. In these fuels, an alternative anti-corrosive agent would be required. An ethanol-based fuel lacking oxygenated aromatic compounds was prepared. It was found that trimethyl pentane was required to make the composition useable in a motor vehicle engine. Again, the lack of oxygenated aromatic compound resulted in the fuel being corrosive. Hence, an alternative anti-corrosive agent would be required.

The content of peanut oil tested ranged from about 0.5-2%. Higher amounts could be used, as would be known to one skilled in the art, for example, up to about 5% peanut oil. Transesterified peanut oil was also tested and was considered to be potentially superior to peanut oil in a fuel injection system. Transesterification of any other suitable vegetable oil would similarly be potentially superior to the vegetable oil without transesterification.

The foregoing is a description of an embodiment of the invention. As would be known to one skilled in the art, variations are contemplated that do not alter the scope of the invention. These include but are not limited to, different combinations of alcohols, different alcohol isomers, and derivatives and analogues of oxygenated natural aromatics.

The invention claimed is:

1. A composition for use as a fuel or fuel additive, comprising:

a petroleum distillate having a flash point from about −22° C. to about −50° C. and comprised of at least one of short chain alkanes, paraffins and napthenes;

at least one alcohol having a ratio of between about 1 to about 4 carbon atoms to 1 hydroxyl functional group;

at least one lubricating oil; and at least one oxygenated natural aromatic compound, wherein the oxygenated natural aromatic compound (i) has a flash point between about 60° C. and about 160° C., (ii) has at least one oxygenated functional group, and (iii) is soluble in the composition.

2. The composition of claim 1 wherein the petroleum distillate is mid flash point to low flashpoint naptha.

3. The composition of claim 2 comprising from about 44% to about 71% v/v mid flash point to low flashpoint naptha, from about 10% to about 34% v/v alcohol, from about 0.5% to about 5% v/v lubricating oil, and from about 0.3% to 17% v/v oxygenated natural aromatic compound.

4. The composition of claim 3 wherein the at least one alcohol is selected from methanol, ethanol, propanol, isopropanol, butanol, isobutanol, tert-butanol and combinations thereof.

5. The composition of claim 4 wherein the oxygenated natural aromatic compound is selected from methyl salicylate, cinnamaldehyde, salicylic acid, eugenol, their analogues and derivatives, and combinations thereof.

6. The composition of claim 5 wherein the oxygenated natural aromatic compound is methyl salicylate.

7. The composition of claim 6 wherein the lubricating oil is peanut oil.

8. The composition of claim 2 comprising from about 44% to about 71% v/v mid flash point to low flashpoint naptha, from about 35% to about 40% v/v butanol or isopropanol or a mixture thereof, from about 0.5% to about 5% v/v lubricating oil, and from about 0.3% to 17% v/v oxygenated natural aromatic compound.

9. The composition of claim 1 comprising:

from about 44% to about 71% v/v petroleum distillate;

from about 10% to about 34% v/v alcohol, wherein the alcohol is (i) one of methanol or ethanol or a combination of methanol and ethanol; or (ii) one of butanol or isopropanol or a combination of butanol and isopropanol;

from about 0.5% to about 5% v/v lubricating oil; and from about 0.3% to 17% v/v methyl salicylate, cinnamaldehyde, salicylic acid, eugenol, their analogues and derivatives, and combinations thereof.

10. The composition of claim 9 comprising about 59% v/v petroleum distillate, about 34% v/v methanol or ethanol or a combination thereof, about 0.5% v/v peanut oil, and about 6% v/v methyl salicylate.

11. The composition of claim 10 comprising from about 44% to about 71% v/v petroleum distillate, from about 35% to about 40% v/v butanol, isopropanol or a mixture thereof, from about 0.5% to about 5% v/v lubricating oil, and from about 0.3% to 17% v/v oxygenated natural aromatic compound.

12. A composition for reducing nitrogen oxide emissions, the composition comprising petroleum distillate, at least one C1 to C4 alcohol, at least one lubricating oil, and at least one oxygenated natural aromatic compound that:

(i) has a flash point between about 50° C. and about 160° C.;

(ii) has at least one oxygenated functional group; and (iii) is soluble in the composition.

13. The composition of claim 12 comprising from about 50% to about 70% v/v of petroleum distillate, the distillate being mid flash point naptha, from about 10% to about 45% v/v alcohol having a ratio of than between about 1 to about 4 carbon atoms to about 1 hydroxyl functional groups, from about 0.5% to about 2% v/v high flash point, high lubricity oil, and from about 3% to 10% v/v oxygenated natural aromatic compound.

14. The composition of claim 13 comprising about 54% v/v mid flash point naptha, about 29% v/v methanol or ethanol, about 0.5% v/v high flash point high lubricity oil, about 10.5% v/v butanol or isopropanol, and about 6% v/v methyl salicylate.

15. The composition of claim 1 further comprising gasoline.

16. A method, comprising:

(i) preparing a composition comprising mid flash point to low flash point naptha, alcohol, wherein the alcohol has a ratio of between about 1 to about 4 carbon atoms to 1 hydroxyl functional group, lubricating oil and an oxygenated natural aromatic compound;

(ii) blending the composition with up to about 90% v/v gasoline to prepare a fuel; and (iii) operating a motor using the fuel.

17. A composition for use as a fuel or a fuel additive, the composition comprising mid flash point to low flashpoint naptha, at least one alcohol having a ratio of between about 1 to about 4 carbon atoms to 1 hydroxyl functional group, at least one high flash point, high lubricity oil, and methyl salicylate, wherein the naptha and the alcohol comprise from about 88% to about 96% v/v of the composition.

18. The composition of claim 17 further comprising gasoline.

19. A method, comprising:

(i) providing a composition comprising a petroleum distillate having a flash point of no higher than −22° C., at least one alcohol having a ratio of between about 1 to about 4 carbon atoms to 1 hydroxyl functional group, at least one high flash point, high lubricity oil, and at least one component that is a combined co-solvent, flame front retarder, and anti-corrosive agent; and (ii) using the composition as a fuel.

20. The method of claim 19, wherein the composition is further defined as comprising from about 50% to about 70% v/v of the petroleum distillate, from about 20% to about 35% v/v of the alcohol, from about 0.3% to about 2% v/v high flash point, high lubricity oil, and from about 3% to 6% v/v of a component that is a combined co-solvent, flame front retarder, and anti-corrosive agent.

21. The method of claim 20 wherein the composition comprises about 54% v/v of petroleum distillate, the distillate being mid flash point naptha, about 29% v/v methanol, about 10.5% isopropanol or butanol, about 0.5% v/v peanut oil, and about 6% v/v methyl salicylate.

22. The method of claim 20 wherein the composition comprises about 54% v/v of petroleum distillate, the distillate being mid flash point naptha, about 29% v/v ethanol, about 10.5% isopropanol or butanol, about 0.5% v/v peanut oil, and about 6% v/v methyl salicylate.

23. The method of claim 19, wherein the composition comprises about 45% v/v butanol.

24. The method of claim 19 wherein the composition comprises about 45% v/v isopropanol.

25. The method of claim 20, wherein the petroleum distillate is naptha having a flash point of no higher than −22° C.

* * * * *